US009811027B2

(12) United States Patent
Tanner et al.

(10) Patent No.: US 9,811,027 B2
(45) Date of Patent: Nov. 7, 2017

(54) LIQUID ELECTROPHOTOGRAPHY INK DEVELOPER

(71) Applicant: Hewlett-Packard Development Company, L.P., Houston, TX (US)

(72) Inventors: Christopher S. Tanner, San Diego, CA (US); David E. Sabo, San Diego, CA (US); Spencer R. Hanson, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/050,420

(22) Filed: Feb. 22, 2016

(65) Prior Publication Data

US 2016/0216644 A1 Jul. 28, 2016

Related U.S. Application Data

(63) Continuation of application No. 14/391,159, filed as application No. PCT/US2012/032657 on Apr. 7, 2012, now Pat. No. 9,291,948.

(51) Int. Cl.
*G03G 15/10* (2006.01)

(52) U.S. Cl.
CPC ..... *G03G 15/104* (2013.01); *G03G 15/10* (2013.01); *G03G 15/101* (2013.01)

(58) Field of Classification Search
CPC ..... G03G 15/10; G03G 15/101; G03G 15/104
USPC ..... 399/237–239
See application file for complete search history.

(56) References Cited

U.S. PATENT DOCUMENTS

| | | | | |
|---|---|---|---|---|
| 5,497,702 | A | 3/1996 | Gorter et al. | |
| 6,108,507 | A | 8/2000 | Chang et al. | |
| 7,356,287 | B2 | 4/2008 | Guzman et al. | |
| 7,657,209 | B2 | 2/2010 | Sabo et al. | |
| 7,668,488 | B2 | 2/2010 | Guzman et al. | |
| 2006/0153597 | A1 | 7/2006 | Guzman et al. | |
| 2008/0141882 | A1 | 6/2008 | Sabo et al. | |
| 2009/0097883 | A1 | 4/2009 | Guzman et al. | |
| 2010/0103437 | A1 | 4/2010 | Li | |
| 2011/0074894 | A1 | 3/2011 | Sabo et al. | |
| 2011/0249989 | A1 * | 10/2011 | Levintant | G03G 15/0812 399/237 |
| 2012/0027468 | A1 | 2/2012 | Nelson et al. | |

FOREIGN PATENT DOCUMENTS

| | | |
|---|---|---|
| JP | 2004-538518 | 12/2004 |
| WO | WO-2011123137 | 10/2011 |

OTHER PUBLICATIONS

Internation Search Report and Written Opinion for PCT/US2012/032657 dated Dec. 3, 2012.

* cited by examiner

*Primary Examiner* — Hoang Ngo
(74) *Attorney, Agent, or Firm* — Rathe Lindenbaum LLP

(57) ABSTRACT

A liquid electrophotographic ink developer comprises a developer roller (112) rotatable about an axis, first and second electrodes (108, 110) proximate the developer roller (112) and an inlet chamber (100) extending along the axis from a first end adjacent an inlet opening (122) to a second end opposite the first end. A neck (104) forms an uninterrupted ink flow path from the inlet chamber (100) to the developer roller (112).

17 Claims, 4 Drawing Sheets

LIQUID ELECTROPHOTOGRAPHY INK DEVELOPER

CROSS REFERENCE TO RELATED APPLICATIONS

This application is a continuation of and claims priority under 35 USC 120 from co-pending U.S. application Ser. No. 14/391,159 filed on Oct. 7, 2014 by Tanner et al. and entitled "LIQUID ELECTROPHOTOGRAPHY INK DEVELOPER", which claims priority from PCT/US2012/032657 by Tanner et al., filed on Apr. 7, 2012, entitled "LIQUID ELECTROPHOTOGRAPHY INK DEVELOPER," the full disclosure of each of which is hereby incorporated by reference in its entirety.

BACKGROUND

Liquid electrophotography (LEP) printing systems form images with liquid toner or ink applied to an electrophotographic surface by one or more developers. Existing developers may result in non-uniform ink development or streaking.

DETAILED DESCRIPTION OF THE EXAMPLE IMPLEMENTATIONS

Figure 1:
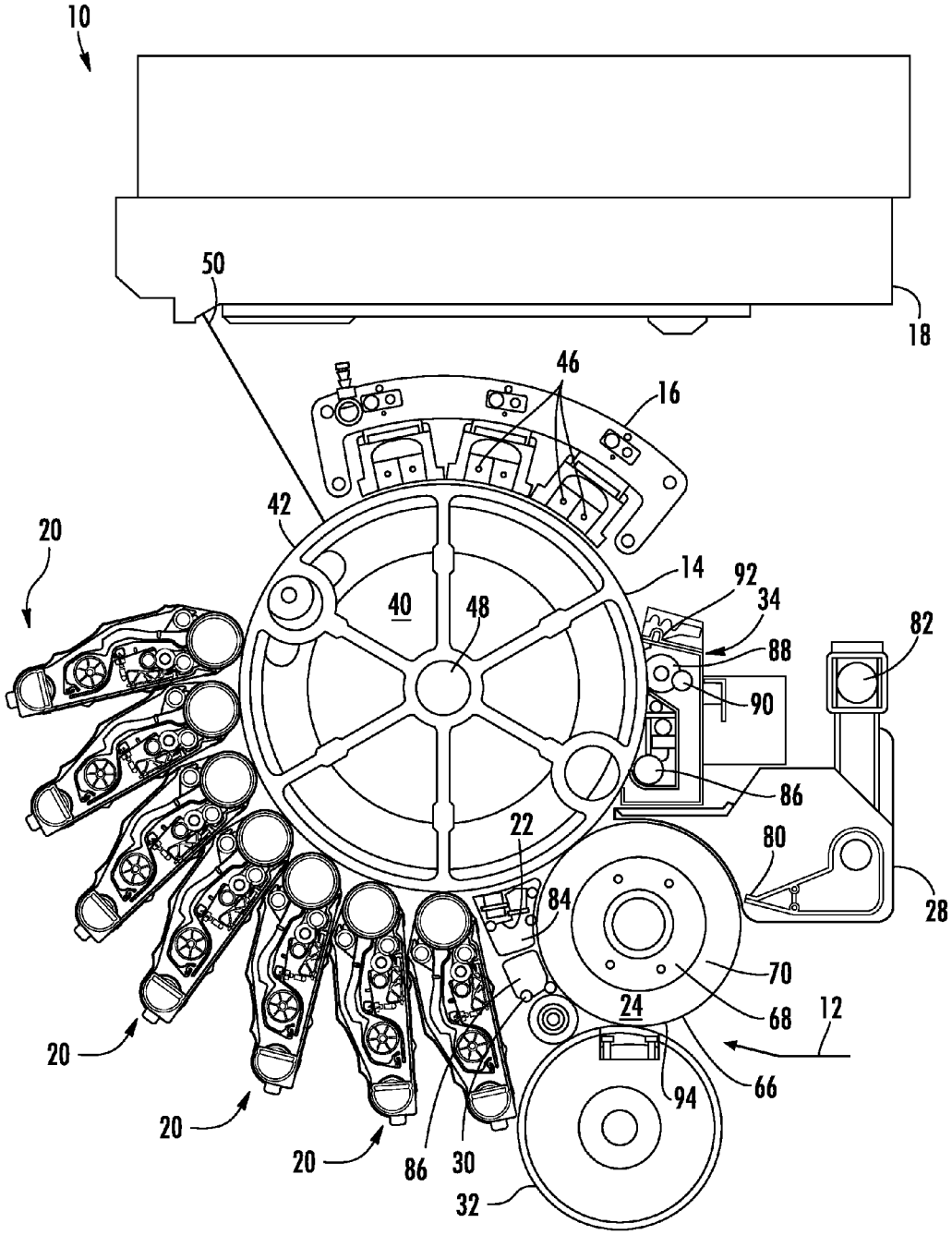
FIG. 1 is a sectional view of an example printer.

FIG. 1 is a schematic illustration of an imaging system or printer 10, sometimes embodied as part of an offset color press, configured to form an image upon a print medium 12 according to one exemplary implementation. Printer 10 includes developers 20. As will be described hereafter, each of developers 20 has an architecture that may provide enhanced development uniformity and performance.

In addition to developer units or developers 20, printer 10, includes photoconductor 14, charger 16, imager 18, charge eraser 22, intermediate transfer member 24, dryers 28, 30, impression member 32 and photoconductor cleaning station 34. Photoconductor 14 generally comprises a cylindrical drum 40 supporting an electrophotographic surface 42, sometimes referred to as a photo imaging plate (PIP). Electrophotographic surface 42 comprises a surface configured to be electrostatically charged and to be selectively discharged upon receiving light from imager 18. Although surface 42 is illustrated as being supported by drum 40, surface 42 may alternatively be provided as part of an endless belt supported by a plurality of rollers. In such an implementation, the exterior surface of the endless belt may be configured to be electrostatically charged and to be selectively discharged for creating an electrostatic field in the form of an image.

Charger 16 comprises a device to electrostatically charge surface 42. In the particular example shown, charger 16 includes 6 corotrons or scorotrons 46. In other implementations, other devices for electrostatically charging surface 42 may be employed.

Imager 18 generally comprises any device to direct light upon surface 42 so as to form an image. In the example shown, imager 18 comprises a scanning laser which is moved across surface 42 as photoconductor 14 is rotated about axis 48. Those portions of surface 42 which are impinged by the light or laser 50 become electrically conductive and discharge electrostatic charge to form an image (and latent image) upon surface 42.

Although imager 18 is illustrated and described as comprising a scanning laser, imager 18 may alternatively comprise other devices configured to selectively emit or selectively allow light to impinge upon surface 42. For example, in other implementations, imager 18 may alternatively include one or more shutter devices which employ liquid crystal materials to selectively block light and to selectively allow light to pass through to surface 42. In other implementations, imager 18 may alternatively include shutters which include individual micro or nano light blocking shutters which pivot, slide or otherwise physically move between the light blocking and light transmitting states.

In still other implementations, surface 42 may alternatively comprise an electrophotographic surface including an array of individual pixels configured to be selectively charged or selectively discharged using an array of switching mechanisms such as transistors or metal-insulator-metal (MIM) devices forming an active array or a passive array for the array of pixels. In such an implementation, charger 16 may be omitted.

Developer units 20 comprise devices to apply printing material 54 to surface 42 based upon the electrostatic charge upon surface 42 and to develop the image upon surface 42. In the particular example shown, printing material 54 generally comprises a liquid or fluid ink comprising a liquid carrier and colorant particles. The colorant particles may have a size of less than 2 microns, although other sizes may be employed in other implementations. In the example illustrated, printing material 54 generally includes up to 6% by weight, and nominally 2% by weight, colorant particles or solids prior to being applied to surface 42. In one implementation, the colorant particles include a toner binder resin comprising hot melt adhesive. In one particular implementation, printing material 54 comprises HEWLETT-PACKARD ELECTRO INK commercially available from Hewlett-Packard. As will be described hereafter with respect to FIG. 2, each developer unit 20 has an architecture that provides enhanced flexibility for the size, shape and positioning of its development electrodes. This flexibility facilitates a more compact developer unit that allows greater manufacturing tolerances and that may provide enhanced development uniformity and performance.

Charge eraser 22 comprises a device situated along surface 42 and configured to remove residual charge from surface 42. In one implementation, charge eraser 22 may comprise an LED erase lamp. In particular implementations, eraser 22 may comprise other devices or may be omitted.

Intermediate transfer member 24 comprises a member configured to transfer printing material 54 from surface 42 to print medium 12. Intermediate transfer member 24 includes an exterior surface 66 which is resiliently compressible and which is configured to be electrostatically charged. Because surface 66 is resiliently compressible, surface 66 conforms and adapts to irregularities on print medium 12. Because surface 66 is configured to be electrostatically charged, surface 66 may be charged to a voltage so as to facilitate transfer of printing material 54 from surface 42 to surface 66.

In the particular implementation shown, intermediate transfer member 24 includes drum 68 and an external blanket 70 which provides surface 66. Drum 68 generally comprises a cylinder supporting blanket 70. In one implementation, drum 68 is formed from a thermally conductive material, such as a metal like aluminum. In such an implementation, drum 68 houses an internal heater (not shown) which heats surface 66.

Blanket 70 wraps about drum 68 and provides surface 66. In one particular implementation, blanket 70 is adhered to drum 68. Blanket 70 includes one or more resiliently compressible layers and includes one or more electrically conductive layers, enabling surface 66 to conform and to be electrostatically charged. Although intermediate transfer member 24 is illustrated as comprising drum 68 supporting blanket 70 which provides surface 66, intermediate transfer member 24 may alternatively comprise an endless belt supported by a plurality of rollers in contact or in close proximity to surface 42 and compressible roller 32.

Dryers 28 and 30 comprise devices to facilitate partial drying of printing material 54 upon surface 66. Dryers 28 and 30 are arranged about intermediate transfer member 24 and configured to direct air towards surface 66 and to withdraw air from surface 66. In the particular example shown, dryer 28 forces air through exit slit 80 which forms an air knife and withdraws or sucks air via exit port 82. Similarly, dryer 28 forces air toward surface 66 via chamber 84 and sucks or withdraws air away from surface 66 via chamber 86. In other implementations, other dryers or drying mechanisms may be employed or dryers 28 and 30 may be omitted.

Impression cylinder 32 comprises a cylinder adjacent to intermediate transfer member 24 so as to form a nip 94 between member 24 and cylinder 32. Media 12 is generally fed between intermediate transfer member 24 and impression cylinder 32, wherein printing material 54 is transferred from intermediate transfer member 24 to medium 12 at nip 94. Although impression member 32 is illustrated as a cylinder or roller, impression member 32 may alternatively comprise an endless belt or a stationary surface against which intermediate transfer member 24 moves.

Cleaning station 34 is arranged proximate to surface 66 between the intermediate transfer member 24 and charger 16. Cleaning station 34 comprises one or more devices configured to remove residual ink and electrical charge from surface 42. In particular examples shown, cleaning station 34 flows a cooled liquid, such as a carrier liquid, across surface 66 between rollers 86, 88. Adhered toner particles are removed by roller 88, which is absorbent. Particles and liquids picked up by the absorbent material of roller 88 is squeegeed out by a squeegee roller 90. The cleaning process of surface 42 is completed by station 34 using a scraper blade 92 which scrapes any remaining toner or ink from surface 66 and keeps the carrier liquid from leaving cleaning station 34. In other implementations, other cleaning stations may be employed or cleaning station 34 may be omitted.

In operation, charger 16 electrostatically charges surface 42. Surface 42 is exposed to light from imager 18. In particular, surface 42 is exposed to laser 50 which is controlled by a raster image processor that converts instructions from a digital file into on/off instructions for laser 50. This results in a latent image being formed for those electrostatically discharged portions of surface 42. Ink developer units 20 develop an image upon surface 42 by applying ink to those portions of surface 42 that remain electrostatically charged. In the implementation shown, printing material 54 contains approximately 2% solids of colorant particles prior to being applied to developer roller 60 of each developer unit 20. Printing material 54 has an approximately 6 micron thick film with approximately 20% solids on developer roller 60 prior to being applied to surface 42.

Once an image upon surface 42 has been developed, eraser 22 erases any remaining electrical charge upon surface 42 and the ink image is transferred to surface 66 of intermediate transfer member 24. In the implementation shown, printing material 54 forms an approximately 1.4 micron thick layer of approximately 85% solids colorant particles with relatively good cohesive strength upon surface 66.

Once the printing material has been transferred to surface 66, heat is applied to printing material 54 so as to melt toner binder resin of the colorant particles or solids of printing material 54 to form a hot melted adhesive. Dryers 28 and 30 partially dry the melted liquid colorant particles. Thereafter, the layer of melted colorant particles forming an image upon surface 66 is transferred to media 12 passing between transfer member 24 and impression cylinder 32. In the implementation shown, the melted colorant particles are transferred to print media 12 at approximately 90 degrees Celsius. The layer of melted colorant particles freeze to media 12 on contact in the nip formed between intermediate transfer member 24 and impression cylinder 32. Thereafter, any remaining printing material 54 and surface 42 is removed by cleaning station 34.

These operations are repeated for every color for preparation in the final image to be produced. In other implementations, in lieu of creating one color separation at a time on surface 66, sometimes referred to as "multi-shot" process, the above-noted process may be modified to employ a one-shot color process in which all color separations are layered upon surface 66 of intermediate transfer member 24 prior to being transferred to and deposited upon medium 12.

Figure 2:
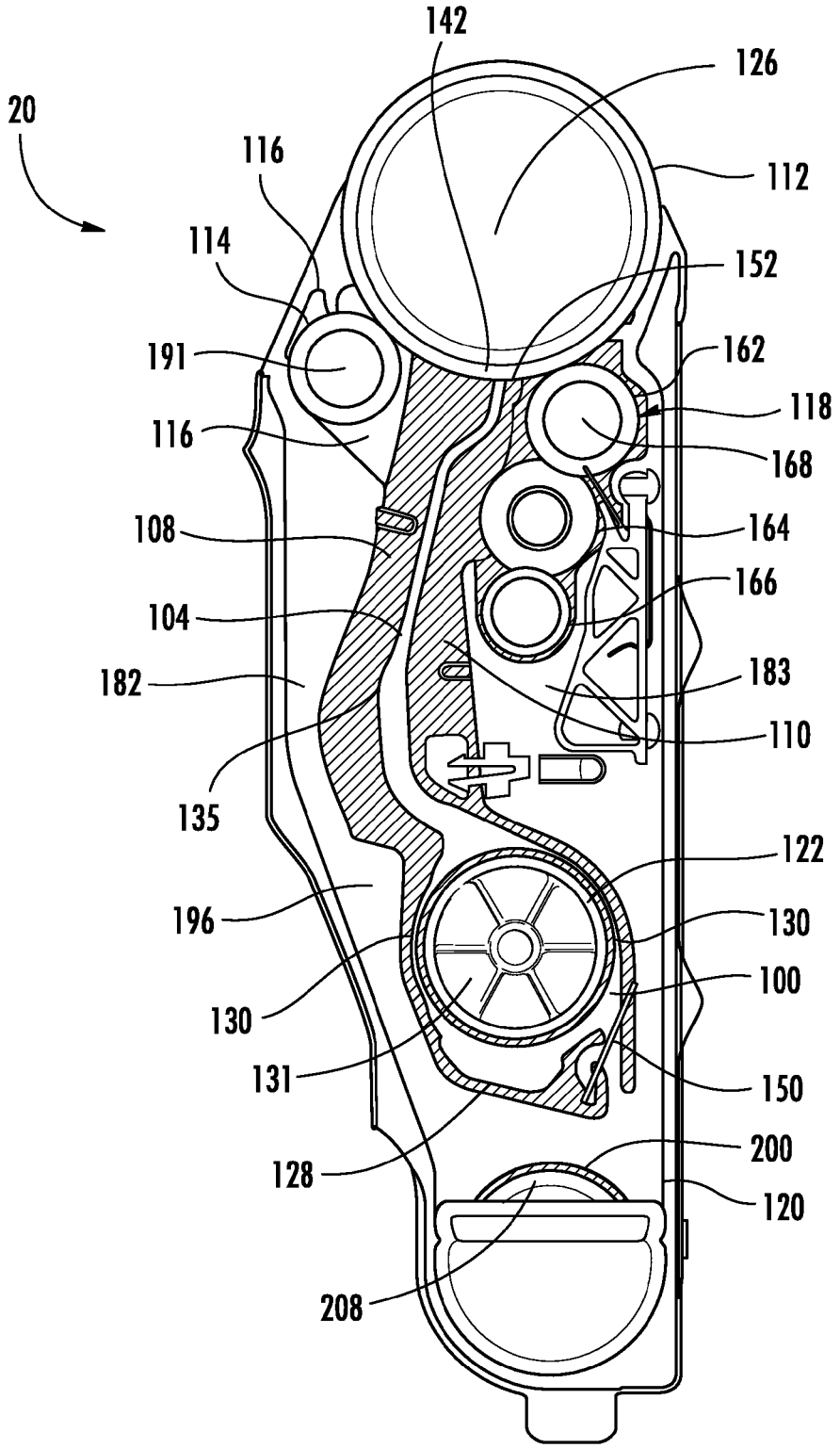
FIG. 2 is a sectional view of an example developer of the printer of FIG. 1.
Figure 3:
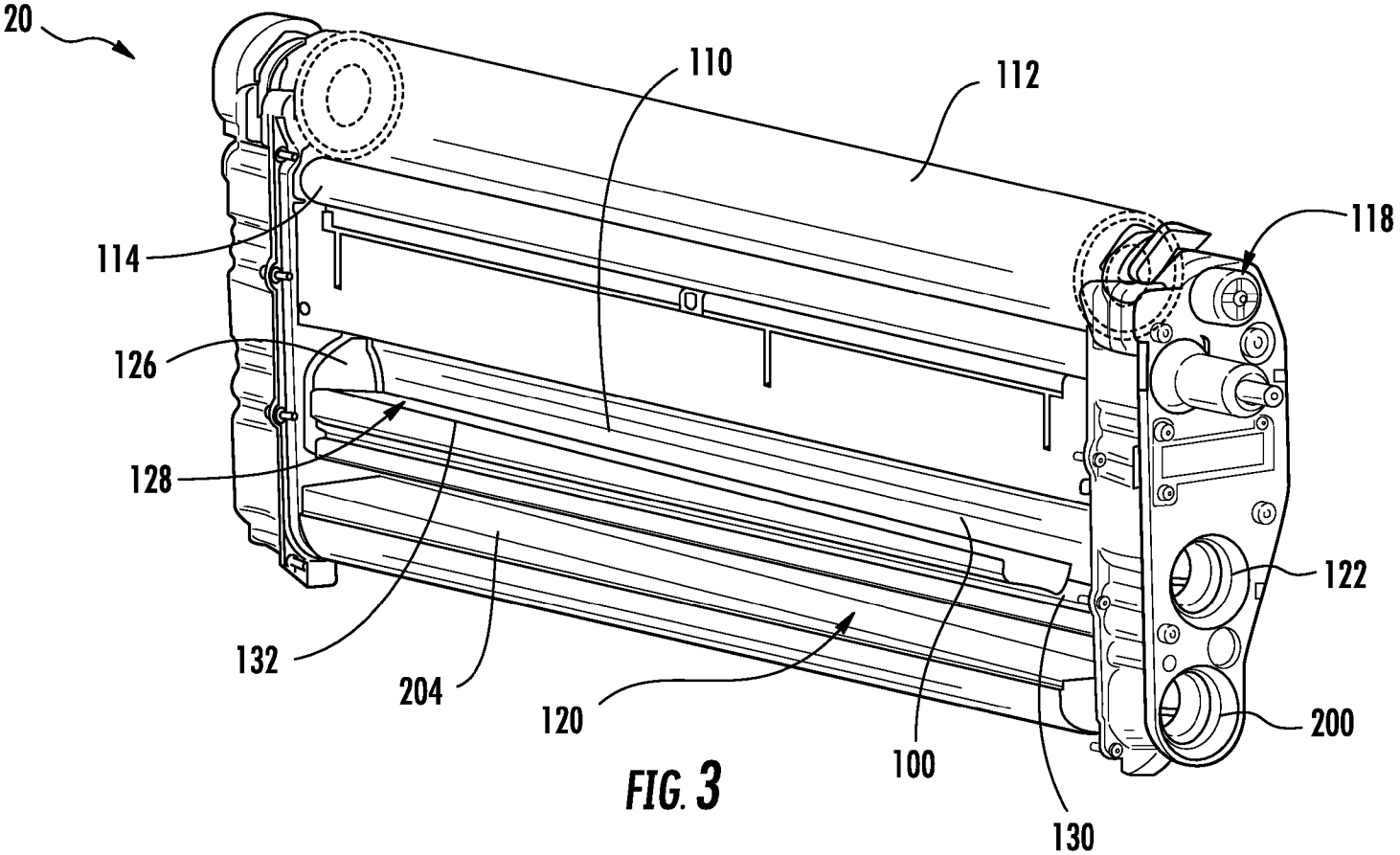
FIG. 3 is a perspective view of the developer of FIG. 2 with portions removed for purposes of illustration.

FIGS. 2-3 illustrate one of development units 20 in detail. Each developer unit 20 generally includes toner or ink inlet chamber 100, neck 104, main electrode 108, back electrode 110, developer roller 112, squeegee roller 114, squeegee cap 116, developer cleaning system 118, and outlet chamber or reservoir 120. Inlet chamber 100 comprises a cavity having an inlet opening 122 through which printing material or ink is supplied to chamber 100. In the example illustrated, chamber 100 is partially surrounded by and is located within reservoir 120. Chamber 100 has an interior volume 124 which extends parallel to a rotational axis of developer roller 112 from inlet opening 122 to a far end 126. Chamber 100 has a cross-sectional area defined or formed by floor 128 and a pair of opposite side walls 130.

Floor 128 extends between inlet opening 122 and far end 126 and comprises sunken portion 130 and elevated portion 132 (shown in FIG. 3). Sunken portion 130 comprises a cutout, depression, detent or drop off with respect to elevated portion 132 that extends between elevated portion 132 and inlet opening 122. Sunken portion 130 extends below inlet opening 122 and nominally below a lowermost portion of inlet opening 122. Sunken portion 130 provides inlet chamber 100 with an enlarged cross-sectional area immediately adjacent to inlet opening 122. As a result, sunken portion 130 allows ink or liquid flow below inlet opening 122 to reduce or inhibit flow of ink immediately upward into neck 104 upon entry into the fluid are inlet cavity or chamber 100. Sunken portion 130 facilitates more uniform ink flow distribution to and along developer roller 112.

In the example implementation illustrated, sunken portion 130 of floor 128 extends a sufficient axial distance away from inlet opening 122 towards end 126 such that the cross-sectional area of inlet chamber 100 is enlarged a sufficient distance towards end 126 to accommodate or absorb the pressure spike that may occur at inlet opening 122 such that a flow pressures level out prior to elevated portion 128. In one implementation, sunken portion 122 extends at least 80 millimeters from inlet opening 122 towards end 126. In one implementation, sunken portion 122 enlarges the cross-sectional area of inlet chamber 100 by at least 120%, and nominally 130%, adjacent or proximate to inlet opening 122.

In the example implementation illustrated, ink is supplied through inlet opening 122 at a rate of 30 $mm^3$ per minute. In such an implementation, sunken portion number 122 nominally extends 100 mm from inlet opening 122 towards end 126. In other implementations where ink supplied through inlet opening 122 at other rates (to accommodate developer roller 126 having different lengths) sunken portion extends from inlet opening 122 towards end 126 by other distances.

Elevated portion 132 extends from sunken portion 130 to end 126. Elevated portion 132 occupies otherwise dead space towards end 126 to distribute flow. In the example illustrated, elevated portion 132 is further sloped or slanted in a downward direction from end 126 towards inlet opening 122. As a result, elevated portion 132 facilitates drainage of ink remaining within developer 20 after usage of developer 20 and prior to removal of developer 20 from printer 10. In one implementation, elevated portion 132 has a slope of less than or equal to 5 degrees and nominally 3 degrees. As a result, the slope is sufficient to facilitate drainage, but small enough to reduce or minimize its impact upon the uniform distribution of ink flow along the axial length of neck 104 and along the axial length of developer roller 112. In one implementation, elevated portion 132 of floor 128 is provided by a wedge inserted into a bottom of inlet chamber 100. In other implementations, portion 132 of floor 128 may be provided by other structures, may have other slopes or may have other extends.

Inlet opening 122 comprises an opening on one end of inlet chamber 100 through which ink is input into inlet chamber 100. Inlet opening 122 extends above the cavity or volume adjacent to sunken portion 130 of floor 128. Inlet opening 122 at a cross-sectional area or diameter sufficiently large to reduce pressure spikes and inhibit ink flow stagnation within inlet chamber 100 adjacent to inlet opening 122. As a result, the size of inlet opening 122 further assists in facilitating uniform ink flow distribution along an axial length of neck 104 and developer roller 112.

In one implementation, inlet opening 122 has a cross-sectional area at least 75% (facing in a direction parallel to the rotational axis of developer roller 112) of a cross-sectional area of inlet chamber 100 extending adjacent to inlet opening 122. In one implementation, inlet opening 122 has a cross-sectional area (facing in a direction parallel to the rotational axis of developer roller 112) at least 90% of the cross-sectional area of inlet chamber 100 at the juncture of elevated portion 128 and sunken portion 130. In the example implementation illustrated, developer roller 112 has a length of 771 mm while inlet opening 122 has a diameter of at least 30 mm. In other implementations inlet opening 122 may have other dimensions depending upon the inlet flow rate and the length of developer roller 112.

In the example illustrated, inlet opening 122 is open and closed with a valve 131. In the example illustrated, valve mechanism 131 automatically closes opening 122 in response to disconnection of developer 120 from printer 10 and automatically opens inlet opening 122 in response to connection of developer 20 to printer 10. In other implementations, inlet opening 122 may be opened and closed by other mechanisms.

Neck 104 extends from inlet chamber 100 to developer roller 112. Neck 104 forms an uninterrupted ink flow path 135 from inlet chamber 100 to developer roller 112. For purposes of this disclosure, the term "uninterrupted" with respect to the flow path provided by neck 104 means that the ink flow path does not include any sharp or drastic flow constrictions, such as baffles, which might otherwise create areas of stagnation or regions of flow turbulence. For purposes of this disclosure, sharp or drastic flow constriction is a flow constriction that has a cross-sectional area (the size of the opening) at least 50% smaller than the immediately adjacent cross-sectional areas of the flow path on both sides of the constriction. In the example implementation illustrated, the ink flow path provided by neck 104 has a width perpendicular to the rotational axis of developer roller 112 that does not enlarge at any point from a midpoint of the length of flow passage provided by neck 104 to developer roller 112. In the example implementation illustrated, the ink flow path provided by neck 104 has a width perpendicular to the rotational axis of developer roller 112 that does not enlarge any point from a top of inlet chamber 122 (as seen in FIG. 2) to developer roller 112. Because neck 104 forms an uninterrupted ink flow path, ink flow is less subject to turbulence which might otherwise create pressure spikes or flow non-uniformity.

In addition to being uninterrupted, the ink flow path provided by neck 104 is relatively skinny or narrow and relatively long. Because neck 104 provides an ink flow path that is skinny and long, neck 104 provides an enhanced pressure drop across its length to enhance uniformity of the ink flow delivered to developer roller 112. In other words, ink flow is more uniformly distributed along the axial length of developer roller 112 as it exits the ink flow path 135. In the example illustrated, the ink flow path 135 provided by neck 104 has a width perpendicular to the rotational axis of developer roller 112 that is less than or equal to 4 mm from a midpoint of the flow path along neck 104 to developer roller 112, and nominally from the top of inlet fluid chamber 100 to developer roller 112. In one implementation, a majority of a length of ink flow passage provided by neck 104 has a width perpendicular to the rotational axis of developer roller 112 that is less than 4 mm and nominally 2 mm. In one implementation, ink flow path provided by neck 104 has a length (measured along a centerline of the main flow path) of at least 65 mm and nominally 75 mm. In other implementations, the ink flow path 135 provided by neck 104 may have greater lengths as allowed depending upon geometries, dimensions and available space within developer 20.

In the example illustrated, flow passage 135 provided by neck 104 has a width perpendicular to the rotational axis of developer roller 112 that is at least 1 mm and nominally at least 1.5 mm. As a result, neck 104 is less susceptible to flow blockages or occlusions along flow passage 135. In other implementations, neck 104 may have a smaller width.

Figure 4:
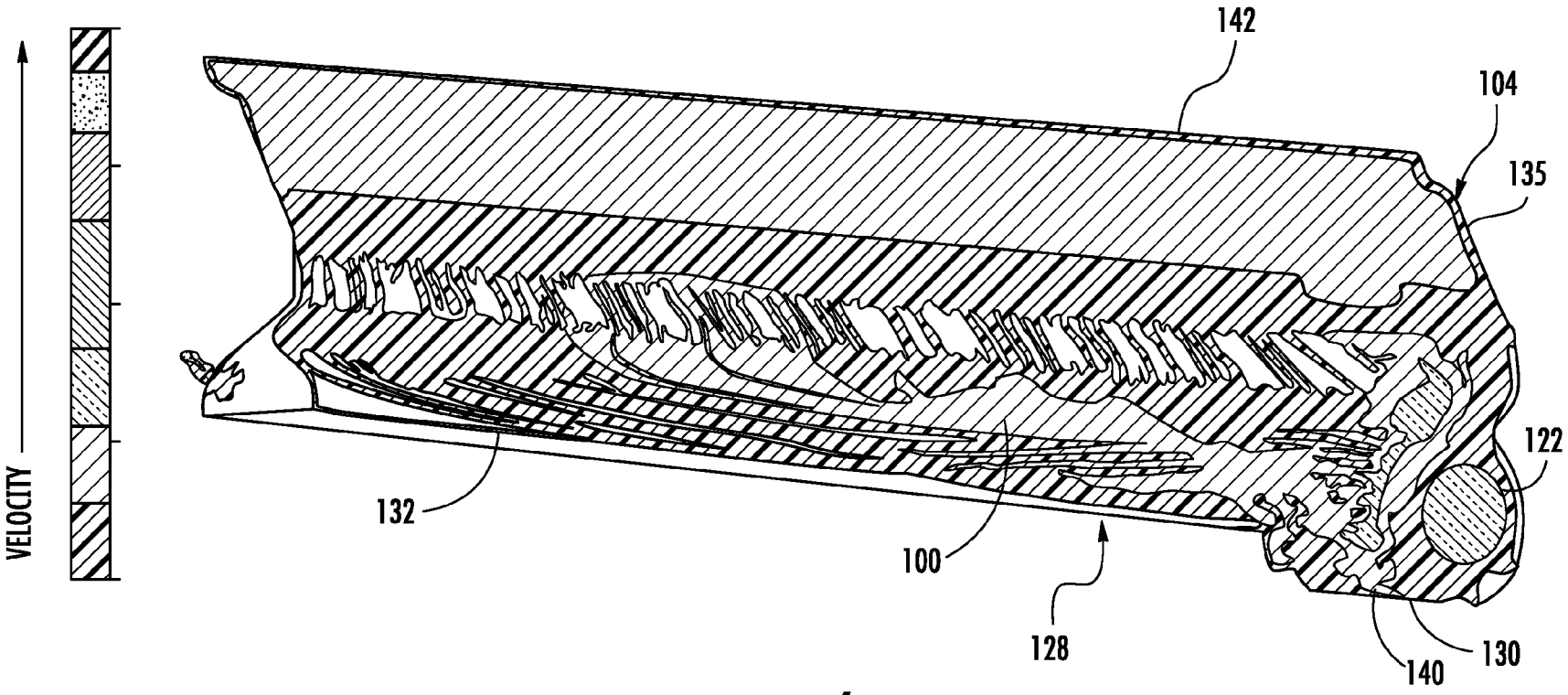
FIG. 4 is an isometric flow model illustrating an example of ink flow within the developer of FIG. 2.

FIG. 4 is a flow model of ink flow within and along developer 20 illustrating flow velocities within and along developer 20. As noted above, the relatively large cross-sectional area of inlet opening 122 slows down inlet velocity to reduce stagnation points and pressure spikes. As indicated at locations 140 adjacent the sunken portion 130 of floor 128, ink flow initially entering through inlet opening 122 drops and flows in the enlarge cross-sectional area to inhibit or reduce immediate ink flow directly upward into flow passage 135 of neck 104. Because ink flow passage 135 of neck 104 is relatively long (the length extending from inlet chamber 100 to discharge point 142 adjacent to developer roller 112 (shown in FIG. 2) and narrow (in a direction perpendicular to the rotational axis of developer roller 112), the velocity of ink flow within and along inlet chamber 100, as well as within and along a flow passage 135 of neck 104, is substantially uniform, not varying by more than 8% along the length of neck 104 along the axial length of developer roller 112.

Referring once again to FIG. 2, main electrode 108 comprises an electrically conductive member supported adjacent to developer roller 112. Back electrode 110 comprises an electrically conductive member supported adjacent to developer roller 112 alongside of main electrode 108. In the example illustrated, back electrode 110 cooperates with main electrode 108 to form neck 104 and its flow passage 135. In the example illustrated, main electrode 108 and back electrode 110 additionally cooperate to form opposing halves of an overall structure that substantially defines inlet chamber 100, wherein elevated portion 132 of floor 128 is provided by a wedge formed or placed within and between electrodes 108, 110.

As shown by FIG. 2, the two halves formed by main electrode 108 and back electrode 110 are joined or sealed to one another at a lower end by a seal 150. In the example illustrated, seal 150 is located substantially below inlet chamber 100 and comprises a polymeric or plastic blade extending from one of electrodes 108, 110 and resiliently biased and pressed against the other of electrodes 108, 110 to seal off inlet chamber 100. Because inlet chamber 100 is formed from two separate halves, electrodes 108 and 110 are more easily manufactured, such as by extrusion. Because seal 100 is elastomeric and is resiliently flexible, seal 100 may bend to accommodate manufacturing variations between the dimensions of the two halves provided by electrodes 108, 110. As a result, electrode 108, 110 may be one with looser manufacturing tolerances.

In other implementations, electrodes 108, 110 may be formed or provided independent of the one or more structures that additionally form and define inlet chamber 100 and/or portions of neck 104. For example, electrodes 108 and 110 may be connected or joined to separate structures that form lower portions of neck 104 and inlet chamber 100. In another implementation, electrodes 108, 110 may form lower portions of neck 104, while being connected to other structures that extend from neck 104 to form inlet chamber 100.

Developer roller 112 comprises a roller configured to be rotatably driven and electrically charged to a voltage distinct from the voltage of electrodes 108 and 110 so as to attract electrically charged ink particles or colorant particles of ink as roller 112 is rotated. Roller 112 is charged such that the charged ink particles being carried by roller 112 are further attracted and drawn to those portions of surface 42 that are electrostatically charged.

Squeegee roller 114 removes excess ink from the surface of roller 112. In particular implementations, squeegee roller 114 may be selectively charged to control the thickness or concentration of ink upon the surface of roller 112. In the example shown, electrodes 108, 110 and squeegee roller 14 are appropriately charged with respect to roller 112 so as to form a substantially uniform 6 micron thick film composed of approximately 20% solids on the surface of roller 112 which is substantially transferred to surface 42 (shown in FIG. 1).

Squeegee cap 116 extends between electrode 108 and squeegee roller 114. Squeegee cap 116 inhibits overflow at squeegee roller 114.

Developer cleaning system 118 removes printing material or ink from developer roller 112 which has not been transferred to surface 42. The removed ink is moved to a reservoir 63 in which colorant particles or solid content of the liquid or fluid is precisely monitored and controlled. In the example illustrated, developer cleaning system 118 includes developer cleaner 162, sponge roller 164 and squeeze roller 166.

Developer cleaner 162 comprises a roller having a surface charged so as to attract and remove the printing material from the surface of roller 112. In one particular implementation in which developer roller 112 has a charge of approximately negative 450 volts, cleaner 162 has a charge of approximately negative 125 volts. Developer cleaner 162 is located in close proximity to developer roller 112 near an upper portion of reservoir 120. In the particular example shown, cleaner 162 is configured to be rotatably driven about axis 168 while in engagement with wiper 164. Although cleaner 162 is illustrated as a roller, cleaner 162 may alternatively comprise a belt movably supported by one or more rollers, wherein a surface of the belt is positioned proximate to developer roller 112 and may be electrically charged for removing printing material from developer roller 112.

Sponge roller 164 comprises a rotatably driven roller form from one or more compressible absorbent sponge-like materials. Sponge roller 166 extends into contact with cleaner 162, electrode 110 and squeeze roller 164 so as to further remove or wipe away sludge and other ink particles from each of cleaner 162 and electrode 110. In other implementations, developer cleaning system 118 may include other structures or mechanisms for removing build up from one or more of cleaner 162, electrode 110 or wiper 164.

Squeeze roller 166 comprises a roller rotatably supported so as to press or squeeze an underside of sponge roller 164 so as to remove printing material from sponge roller 164. In other implementations, squeeze roller 166 may be omitted in favor of a scraper blade positioned above or below sponge roller 164

In operation, ink supplied through inlet 122 and flows along inlet chamber 100 and up through neck 104 between electrode 108 and 110 towards developer roller 112. A portion of the ink is pumped by developer roller 112 across gap 142. Portions of ink not developed upon roller 112 returns to the interior 196 of chamber 100 through return passage 182.

Outlet chamber or reservoir 120 comprises an elongate cavity below inlet chamber 100 and having an outlet opening 200. Reservoir 120 receives ink that has flowed across gap 142 which is returned through passage 182 to the interior 196 of reservoir 120. In the example illustrated, reservoir 120 has a floor 204 which slopes downwardly from end 126 to outlet opening 200. In the example illustrated, floor 204 slopes across substantially an entire length of reservoir 120. The slope of floor 204 facilitates drainage of ink remaining within developer 20 after usage of developer 20 and prior to removal of developer 20 from printer 10. In one implementation, floor 204 has a slope of less than or equal to 5 degrees and nominally 3 degrees. In one implementation, floor 204 is provided by a wedge inserted into a bottom of inlet reservoir 20. In other implementations, floor 204 may be provided by other structures, may have other slopes or may have other extends.

Outlet opening 200 comprises an opening on one end of reservoir 120 through which ink is discharged from developer 20. In the example illustrated, outlet opening 200 extends on a same side as inlet opening 122. In other implementations, outlet opening 200 is located on an opposite side, end 126. As with inlet opening 122, outlet opening 200 includes a valve 208 which automatically closes in response to disconnection of developer 20 from printer 10.

Overall, developer 20 provides uniform laminar flow owing to developer roller 20 without induced turbulence that might otherwise be generated by small slots and fast velocities generated by such sharp flow constrictions on the fluid flow path between inlet chamber 100 and developer roller 112. In addition, by eliminating such sharp flow constrictions, the risk of sludge build up and air entrapment is reduced. By providing a more uniform laminar flow of ink to developer roller 112, print quality may be enhanced.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. A liquid electrophotography (LEP) ink developer comprising:

a developer roller rotatable about an axis;

first and second rollers proximate the developer roller;

an inlet chamber extending along the axis from a first end adjacent an inlet opening to a second end opposite the first end;

a neck forming an uninterrupted ink flow path from the inlet chamber to the developer roller, wherein the inlet chamber has a first cross-sectional area proximate to the first end and a second cross-sectional area proximate to the second end adjacent the inlet opening, the second cross-sectional area being greater than the first cross-sectional area, and wherein a first portion of floor is sloped from the second end downwardly towards the first end; and first and second electrodes that form first and second halves of an enclosure providing separate pieces joined to one another to form the inlet chamber and wherein the apparatus further comprises a seal sealing between the first and second electrodes to close the inlet chamber below the inlet chamber.

2. The developer of claim 1, wherein the neck has a width perpendicular to the axis that does not enlarge from the inlet chamber to the developer roller as the neck approaches the developer roller.

3. The developer of claim 2, wherein the width is greater than or equal to 1.5 mm and less than or equal to 4 mm.

4. The developer of claim 1, wherein the neck has a length of at least 65 mm.

5. The developer of claim 1, wherein the inlet opening has a diameter of at least 30 mm.

6. The developer of claim 1, wherein the inlet chamber has a first cross-sectional area adjacent the inlet opening and wherein inlet opening has a second cross-sectional area at least 75% of the first cross-sectional area.

7. The developer of claim 1 further comprising a second sunken portion extending from the inlet opening to at least 80 mm from the inlet opening along the axis.

8. The developer of claim 1, wherein the first portion of floor is sloped in a direction perpendicular to the axis.

9. A liquid electrophotography (LEP) ink developer comprising:

a developer roller rotatable about an axis;

first and second rollers proximate the developer roller;

an inlet chamber extending along the axis from a first end adjacent an inlet opening to a second end opposite the first end, wherein a first portion of floor is sloped from the second end downwardly towards the first end;

a neck forming an uninterrupted ink flow path from the inlet chamber to the developer roller; and first and second electrodes that form first and second halves of an enclosure providing separate pieces joined to one another to form forming the inlet chamber and wherein the apparatus further comprises a seal sealing between the first and second electrodes to close the inlet chamber below the inlet chamber.

10. The developer of claim 9, wherein the neck has a width perpendicular to the axis that does not enlarge from the inlet chamber to the developer roller as the neck approaches the developer roller.

11. The developer of claim 9, wherein the inlet chamber has a first cross-sectional area adjacent the inlet opening and wherein inlet opening has a second cross-sectional area at least 75% of the first cross-sectional area.

12. The developer of claim 9, further comprising a second sunken portion extending from the inlet opening to at least 80 mm from the inlet opening along the axis.

13. The developer of claim 12, wherein the first portion of floor is sloped in a direction perpendicular to the axis.

14. A liquid electrophotography (LEP) ink developer comprising:

a developer roller rotatable about an axis;

first and second rollers proximate the developer roller;

an inlet chamber extending along the axis from a first end adjacent an inlet opening to a second end opposite the first end;

a neck forming an uninterrupted ink flow path from the inlet chamber to the developer roller, wherein a first portion of floor is sloped from the second end downwardly towards the first end.

15. The developer of claim 14, wherein the first portion of floor is sloped in a direction perpendicular to the axis.

16. The developer of claim 14, wherein the neck has a width perpendicular to the axis that does not enlarge from the inlet chamber to the developer roller as the neck approaches the developer roller.

17. The developer of claim 16, wherein the width is greater than or equal to 1.5 mm and less than or equal to 4 mm.

* * * * *